US010365579B2

(12) United States Patent
Suzuki

(10) Patent No.: US 10,365,579 B2
(45) Date of Patent: Jul. 30, 2019

(54) IMAGE FORMING SYSTEM FOR FORMING A LIGHT CORRECTED IMAGE BASED UPON BOTH A LIGHT EMITTING DEVICE AND AN IMAGE FORMING DEVICE, IMAGE FORMING METHOD, AND NON-TRANSITORY RECORDING MEDIUM

(71) Applicant: Masashi Suzuki, Saitama (JP)

(72) Inventor: Masashi Suzuki, Saitama (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/806,732

(22) Filed: Nov. 8, 2017

(65) Prior Publication Data

US 2018/0239271 A1 Aug. 23, 2018

(30) Foreign Application Priority Data

Feb. 17, 2017 (JP) ..... 2017-027880

(51) Int. Cl.
*G03G 15/00* (2006.01)
*G03G 15/043* (2006.01)

(52) U.S. Cl.
CPC ..... *G03G 15/043* (2013.01); *G03G 15/5062* (2013.01); *G03G 15/55* (2013.01)

(58) Field of Classification Search
None
See application file for complete search history.

(56) References Cited

U.S. PATENT DOCUMENTS

2009/0231606 A1 9/2009 Kawai et al.
2010/0253981 A1 10/2010 Higashiyama et al.
2011/0228355 A1* 9/2011 Morita ..... G03G 15/043 358/475
2014/0063168 A1 3/2014 Maeda et al.
2014/0168343 A1 6/2014 Suzuki et al.
2015/0261116 A1 9/2015 Murota et al.
2015/0261117 A1 9/2015 Suzuki et al.

FOREIGN PATENT DOCUMENTS

JP 2002-225337 8/2002
JP 2015-085525 5/2015

* cited by examiner

*Primary Examiner* — Victor Verbitsky
(74) *Attorney, Agent, or Firm* — Harness, Dickey & Pierce, P.L.C.

(57) ABSTRACT

An image forming system includes a light emitting device, a controller, an image forming device, an acquiring device, a calculator, and a storage device. The controller corrects an amount of light, which is outputted from the light emitting device, based on a first correction value stored in the storage device. The image forming device forms a test image with the amount of light corrected based on the first correction value. The acquiring device acquires density information indicating a characteristic of density of the test image. The calculator calculates a second correction value based on the density information and calculates a third correction value based on the first correction value and the second correction value. The controller corrects the amount of light based on the third correction value. The image forming device forms a target image with the amount of light corrected based on the third correction value.

15 Claims, 14 Drawing Sheets

IMAGE FORMING SYSTEM FOR FORMING A LIGHT CORRECTED IMAGE BASED UPON BOTH A LIGHT EMITTING DEVICE AND AN IMAGE FORMING DEVICE, IMAGE FORMING METHOD, AND NON-TRANSITORY RECORDING MEDIUM

CROSS-REFERENCE TO RELATED APPLICATION

This patent application is based on and claims priority pursuant to 35 U.S.C. § 119(a) to Japanese Patent Application No. 2017-027880, filed on Feb. 17, 2017, in the Japan Patent Office, the entire disclosure of which is hereby incorporated by reference herein.

BACKGROUND

Technical Field

Embodiments of the present disclosure relate to an image forming system, an image forming method, and a non-transitory recording medium.

Related Art

Various types of image forming systems are known, that usually form an image on a medium with light. Specifically, in such image forming systems, for example, a charger uniformly charges a surface of an image bearer such as a photoconductor. An optical writer including a light emitting device irradiates the surface of the image bearer thus charged with a light beam emitted by the light emitting device to form an electrostatic latent image on the surface of the image bearer according to image data. A developing device supplies a developer such as toner to the electrostatic latent image thus formed to render the electrostatic latent image visible as a toner image, for example. The toner image is then transferred onto a medium such as a recording medium either directly, or indirectly via an intermediate transfer belt. Finally, a fixing device applies heat and pressure to the medium bearing the toner image to fix the toner image onto the medium. Thus, an image is formed on the medium.

SUMMARY

In one embodiment of the present disclosure, a novel image forming system includes a light emitting device, a controller, an image forming device, an acquiring device, a calculator, and a first storage device. The light emitting device is configured to output light. The controller is configured to control an amount of light that is outputted from the light emitting device. The image forming device is configured to form an image on a medium with the light. The acquiring device is configured to acquire density information indicating a characteristic of density of the image. The calculator is configured to calculate a correction value. The first storage device is configured to store a first correction value corresponding to a characteristic of the light emitting device. The controller is configured to correct the amount of light based on the first correction value. The image forming device is configured to form a first test image with the amount of light corrected based on the first correction value. The acquiring device is configured to acquire first density information indicating a characteristic of density of the first test image. The calculator is configured to calculate a second correction value based on the first density information and calculate a third correction value based on the first correction value and the second correction value. The controller is configured to correct the amount of light based on the third correction value. The image forming device is configured to form a first target image with the amount of light corrected based on the third correction value.

Also described are a novel image forming method and a novel non-transitory recording medium.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
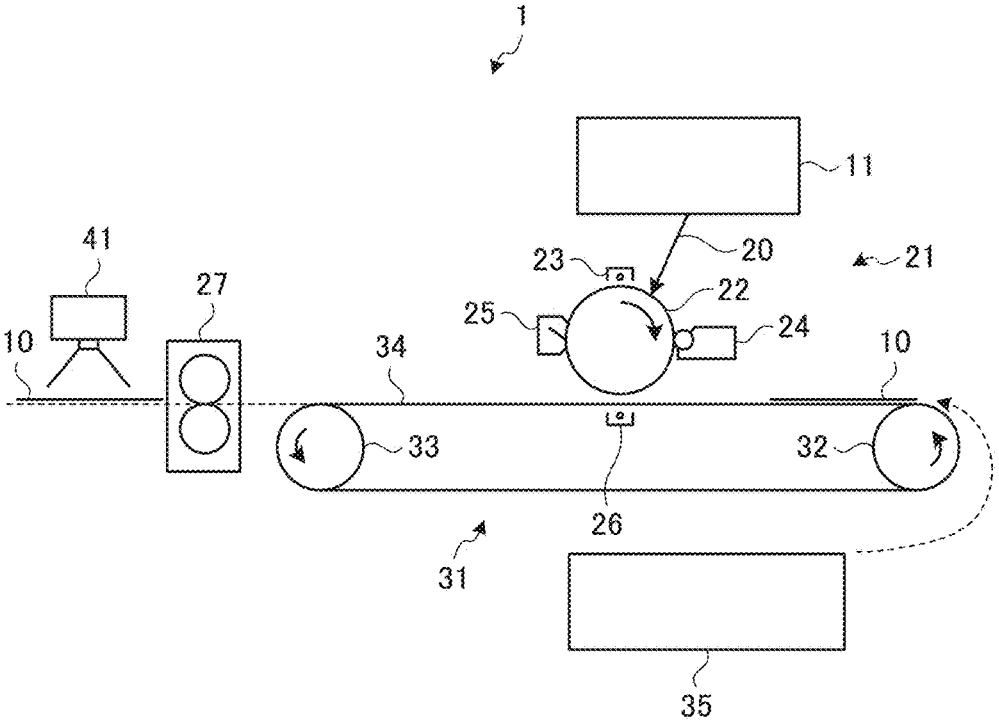
FIG. 1 is a schematic view of a hardware structure of an image forming system according to a first embodiment.

In describing embodiments illustrated in the drawings, specific terminology is employed for the sake of clarity.

However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and not all of the components or elements described in the embodiments of the present, disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below.

Initially with reference to FIGS. 1 through 11, a description is given of a first embodiment of the present disclosure.

Figure 2:
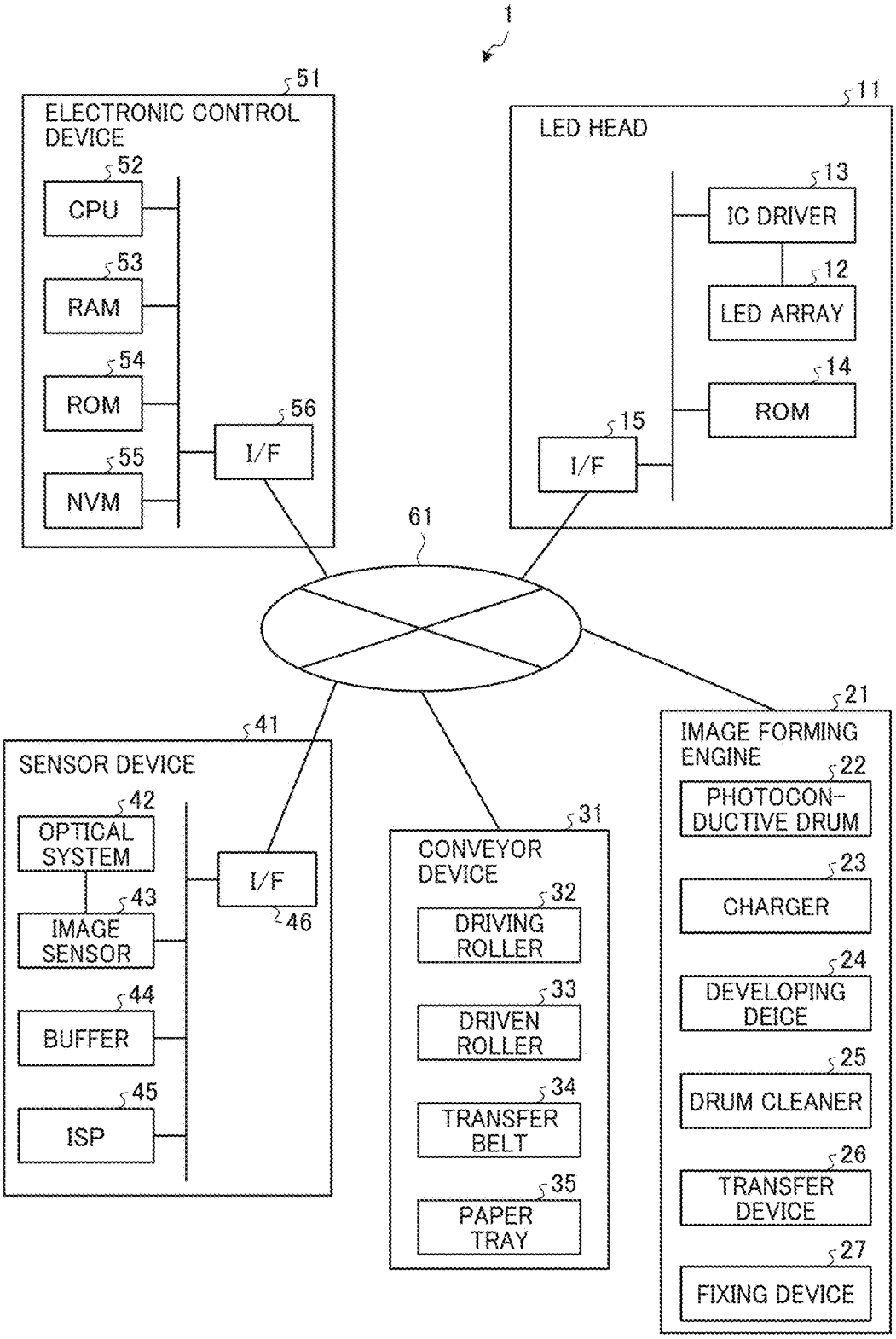
FIG. 2 is a block diagram of the hardware structure of the image forming system according to the first embodiment.

Firstly, a description is given of a hardware structure of an image forming system 1 according to the first embodiment with reference to FIGS. 1 and 2.

FIG. 1 is a schematic view of the hardware structure of the image forming system 1. FIG. 2 is a block diagram of the hardware structure of the image forming system 1.

The image forming system 1 includes a light emitting diode (LED) head 11, an image forming engine 21, a conveyor device 31, a sensor device 41, an electronic control device 51, and a network 61. The image forming system 1 is a system that forms a desired image on a medium 10 with light 20 outputted from the LED head 11. The image forming system 1 may be a copier, a facsimile machine, a printer, a multifunction peripheral (MFP) having at least two of copying, printing, scanning, facsimile, and plotter functions, or the like.

Now, a detailed description is given of a construction of each of the LED head 11, the image forming engine 21, the conveyor device 31, the sensor device 41, and the electronic control device 51.

The LED head 11 is a unit that outputs the light 20. As illustrated in FIG. 2, the LED head 11 includes a light emitting diode (LED) array 12, an integrated circuit (IC) driver 13, a read only memory (ROM) 14, and an interface (I/F) 15.

The LED array 12 is a device constructed of a plurality of LEDs arrayed. The IC driver 13 is a semiconductor device that controls an amount of light of the LED array 12. The IC driver 13 may control the amount of light of the LED array 12 so as to change an amount of light emitted by the individual LEDs. The IC driver 13 is driven according to a control signal from the electronic control device 51. For example, the IC driver 13 is configured to change a drive current supplied to the LED array 12 according to the control signal. The ROM 14 is a nonvolatile memory that stores various types of data with respect to the output of the light 20. The I/F 15 is a device that sends and receives signals to and from other units or devices (e.g., electronic control device 51) via the network 61.

According to the present embodiment, the ROM 14 stores data indicating a correction value corresponding to a characteristic of the LED head 11. A detailed description of the correction value is deferred.

As illustrated in FIGS. 1 and 2, the image forming engine 21 includes a photoconductive drum 22 serving as a photoconductor, a charger 23, a developing device 24, a drum cleaner 25, a transfer device 26, and a fixing device 27. The conveyor device 31 includes a driving roller 32, a driven roller 33, a transfer belt 34, and a paper tray 35.

The photoconductive drum 22 is a cylinder that bears a latent image and a toner image. The charger 23 uniformly charges the surface of the photoconductive drum 22. The LED head 11 irradiates the surface of the photoconductive drum 22 thus charged, with the light 20 so as to draw a predetermined trajectory according to predetermined image data. Thus, an electrostatic latent image is formed in a predetermined shape on the surface of the photoconductive drum 22. The developing device 24 supplies toner to the electrostatic latent image, rendering the electrostatic latent image visible as a toner image on the surface of the photoconductive drum 22. The electronic control device 51 outputs control signals to control operations of the photoconductive drum 22, the charger 23, and the developing device 24.

The transfer device 26 transfers the toner image from the surface of the photoconductive drum 22 onto the medium 10. In the conveyor device 31, the paper tray 35 houses the medium 10 therein, while being provided with a mechanism to send out the medium 10 onto the transfer belt 34. Thus, the paper tray 35 serves as a sheet feeder with the mechanism. The transfer belt 34 is entrained around the driving roller 32 and the driven roller 33. The driving roller 32 drives and rotates the transfer belt 34 to convey the medium 10. The electronic control device 51 is timed to output control signals to control operations of the transfer device 26, the driving roller 32, and the paper tray 35 such that the toner image is transferred from the surface of the photoconductive drum 22 onto the medium 10.

In the image forming engine 21, the drum cleaner 25 removes residual toner from the surface of the photoconductive drum 22 after the toner is transferred onto the medium 10. In this case, the residual toner is toner that has failed to be transferred onto the medium 10 and therefore remains on the surface of the photoconductive drum 22. Meanwhile, the medium 10 bearing the toner image is conveyed to the fixing device 27. The fixing device 27 fixes the toner image onto the medium 10 under heat and pressure. The electronic control device 51 outputs control signals to control operations of the drum cleaner 25 and the fixing device 27.

The sensor device 41 is a unit that acquires data for generating density information on the density of an image formed on the medium 10 (i.e., toner image fixed onto the medium 10). As illustrated in FIG. 2, the sensor device 41 includes an optical system 42, an image sensor 43, a buffer 44, an image signal processor (ISP) 45, and an interface (I/F) 46.

The image sensor 43, such as a complementary metal-oxide-semiconductor (CMOS) sensor or a charge coupled device (CCD) sensor, acquires an optical signal of the image on the medium 10 via the optical system 42 such as a lens, to photoelectrically convert the optical signal into an electric signal. The ISP 45 is a device that performs predetermined image processing, such as noise removal, on the electric signal converted by the image sensor 43. The ISP 45 may be a logic circuit that performs relatively simple processing such as noise removal, or may be a circuit that performs relatively advanced information processing (e.g., calculation of image density), with a processor that performs arithmetic processing according to a predetermined program. After processing data, the ISP 45 transmits the processed data to the electronic control device 51 via the I/F 46 and the network 61. The buffer 44 is, e.g., a semiconductor memory that temporarily stores the electric signal converted by the image sensor 43, the data processed by the ISP 45, and the like.

The electronic control device 51 is a unit that controls the entire image forming system 1. The electronic control device 51 includes a central processing unit (CPU) 52, a random access memory (RAM) 53, a read only memory (ROM) 54, a nonvolatile memory (NVM) 55, and an interface (I/F) 56.

The ROM 54 stores a program for controlling the image forming system 1. The CPU 52 performs various types of arithmetic processing to control the image forming system 1 according to the program stored in the ROM 54. The RAM 53 is a memory that functions mainly as a work area of the CPU 52. The NVM 55 is a nonvolatile memory that stores various types of data for controlling the image forming system 1. The I/F 56 is a device that sends and receive signals to and from other units or devices, namely, the LED head 11, the image forming engine 21, the conveyor device 31, and the sensor device 41, via the network 61.

According to the present embodiment, the NVM 55 stores data indicating correction values corresponding to characteristics of constituent elements of the image forming system 1. A detailed description of the correction values is deferred.

Typically image forming systems that form images with light have been suffering from variations in density arising from characteristics of constituent elements of the image forming systems, particularly, characteristics of a light emitting device and an image forming device that forms images with light from the light emitting device.

To address this circumstance, according to the embodiments of the present disclosure, such variations in density are suppressed depending on the characteristics of constituent elements of the image forming system, including the light emitting device and the image forming device, thereby enhancing image quality.

Figure 3:
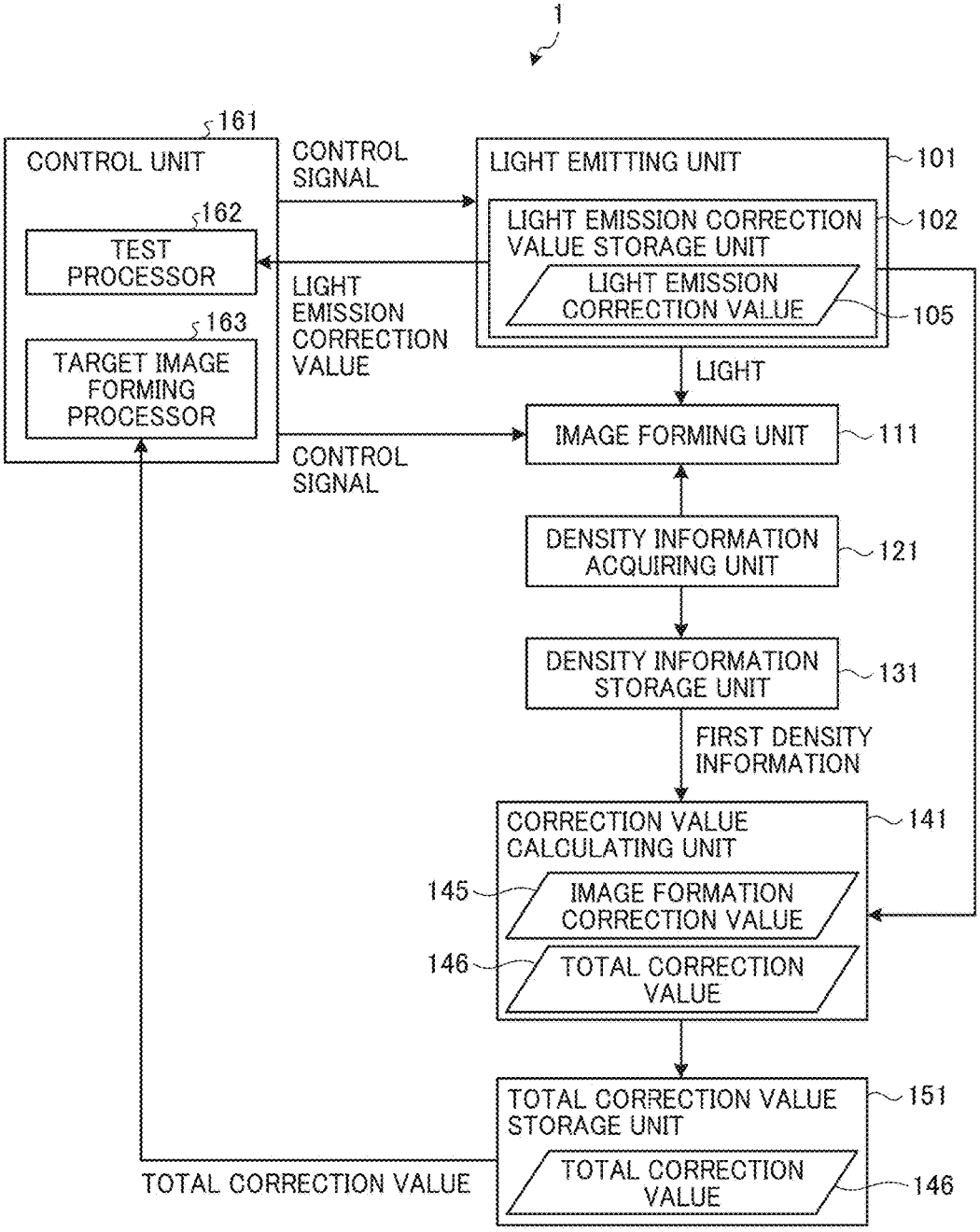
FIG. 3 is a block diagram of a functional structure of the image forming system according to the first embodiment.

Referring now to FIG. 3, a description is given of a functional structure of the image forming system 1 according to the first embodiment.

FIG. 3 is a block diagram of the functional structure of the image forming system 1.

The image forming system 1 includes a light emitting unit 101 serving as a light emitting device, an image forming unit 111 serving as an image forming device, a density information acquiring unit 121 serving as an acquiring device, a density information storage unit 131, a correction value calculating unit 141 serving as a calculator, a total correction value storage unit 151 serving as a second storage device, and a control unit 161 serving as a controller.

The light emitting unit 101 is a functional unit that outputs the light 20. The light emitting unit 101 includes, e.g., the LED head 11. According to a control signal from the control unit 161, the light emitting unit 101 changes the amount of light that the LED head 11 outputs.

The light emitting unit 101 includes a light emission correction value storage unit 102 serving as a first storage device. The light emission correction value storage unit 102 is a functional unit that stores data indicating a light emission correction value 105 serving as a first correction value. The light emission correction value storage unit 102 includes, e.g., the ROM 14 of the LED head 11. The light emission correction value 105 is a correction value corresponding to a characteristic of the light emitting unit 101. The light emission correction value 105 is set so as to suppress variations in density arising from the characteristic of the light emitting unit 101. The characteristic of the light emitting unit 101 that may cause such variations in density includes, e.g., variations in the light emission capabilities of the LEDs constructing the LED array 12, variations in the arrangement of the LEDs, and variations in the drive current supplied to the LIE) array 12. Since the light emission correction value 105 is usually unique to each constituent element (e.g., hardware) of the light emitting unit 101, the light emission correction value 105 changes depending on the hardware in use. Therefore, the light emission correction value 105 may be calculated in advance with a predetermined device for each of hardware components (e.g., LED head 11) constructing the light emitting unit 101, to be stored in the corresponding light emission correction value storage unit 102 (e.g., ROM 14).

The image forming unit 111 is a functional unit that forms an image on the medium 10 with the light outputted from the light emitting unit 101. The image forming unit 111 includes a mechanism to form a latent image on a photoconductor (e.g., photoconductive drum 22) with the light (e.g., light 20) outputted from the light emitting unit 101 (e.g., LED head 11), to supply toner to the latent image, and to transfer the toner onto the medium 10. For example, the image forming unit 111 includes the image forming engine 21 and the conveyor device 31 described above. The image forming unit 111 is controlled according to a control signal from the control unit 161.

The density information acquiring unit 121 is a functional unit that acquires density information on density of the image formed on the medium 10. In other words, the density information acquiring unit 121 acquires density information indicating a characteristic of density of the image. The density information acquiring unit 121 includes, e.g., the sensor device 41 and the electronic control device 51.

The density information storage unit 131 is a functional unit that stores data indicating the density information acquired by the density information acquiring unit 121. The density information storage unit 131 includes the buffer 44 of the sensor device 41, the RAM 53 and the NVM 55 of the electronic control device 51, and the like.

The correction value calculating unit 141 is a functional unit that calculates correction values corresponding to the characteristics of the constituent elements of the image forming system 1. For example, the correction value calculating unit 141 calculates a correction value so that the control unit 161 controls an amount of light based on the total correction value to suppress variations in the density of the image. The correction value calculating unit 141 includes, e.g., the electronic control device 51. Specifically, the correction value calculating unit 141 calculates an image formation correction value 145, serving as a second correction value, and a total correction value 146 serving as a third correction value. The image formation correction value 145 is a correction value corresponding to a characteristic of the image forming unit 111. The image formation correction value 145 is set so as to suppress variations in density arising from the characteristic of the image forming unit 111. The total correction value 146 is a correction value corresponding to both the characteristic of the light emitting unit 101 and the characteristic of the image forming unit 111. The total correction value 146 is set so as to suppress variations in density arising from both the characteristic of the light emitting unit 101 and the characteristic of the image forming unit 111. A detailed description of how to calculate the image formation correction value 145 and the total correction value 146 is deferred.

The total correction value storage unit 151 is a functional unit that stores the total correction value 146 calculated by the correction value calculating unit 141. The total correction value storage unit 151 includes, e.g., the NVM 55 of the electronic control device 51.

The control unit 161 is a functional unit that performs various types of processing to control the image forming system 1. The control unit 161 controls an amount of light outputted from the light emitting unit 101. The control unit 161 includes, e.g., the electronic control device 51. The control unit 161 generates the control signal to control the light emitting unit 101 and the control signal to control the image forming unit 111.

As illustrated in FIG. 3, the control unit 161 includes a test processor 162 and a target image forming processor 163. The test processor 162 is a functional unit that performs test processing to acquire density information of the image formed on the medium 10. The target image forming processor 163 is a functional unit that calculates a correction value based on a result of the test processing and performs print processing to form a target image on the medium 10 based on the correction value.

Referring now to FIGS. 3 through 8, a description is given of the test processing.

Hereinafter, a description is given of operations performed by the functional units described above during the test processing. The test processor 162 performs processing to form a test pattern 171, herein serving as a first test image, on the medium 10. The test pattern is an image used to acquire the density information indicating characteristics of variations in density arising from the characteristics of the constituent elements of the image forming system 1.

Figure 4:
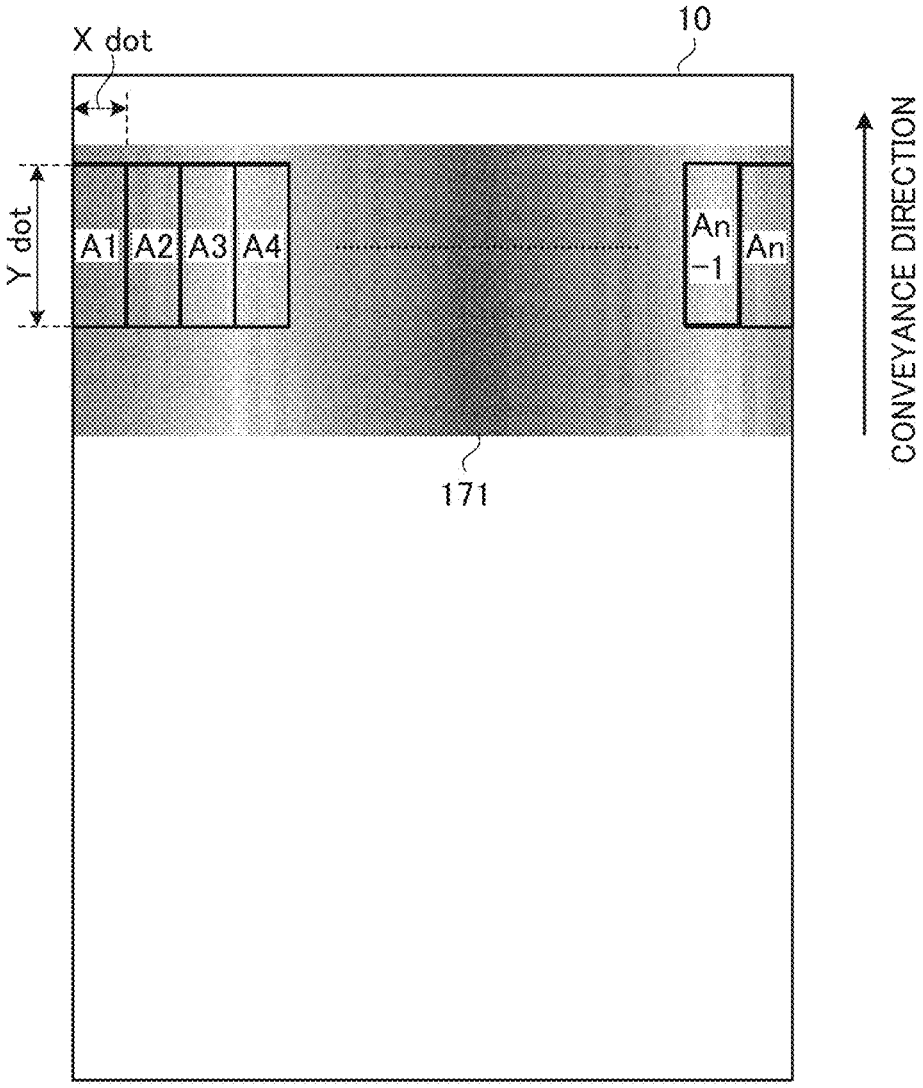
FIG. 4 is a plan view of a test pattern formed on a medium according to the first embodiment.

FIG. 4 is a plan view of the test pattern 171 formed on the medium 10 according to the first embodiment.

In the present example, the test pattern 171 is a uniform halftone image in both a main scanning direction and a sub-scanning direction. The sub-scanning direction is a conveyance direction in which the medium 10 is conveyed. The main scanning direction is a direction perpendicular to the conveyance direction (i.e., sub-scanning direction). When the test pattern 171 is formed on the medium 10, specific variations in the characteristics of the constituent elements of, e.g., the light emitting unit 101 and the image forming unit 111 may vary the density of the test pattern 171. The density information indicates characteristics of such variations in density. For example, the density information may indicate a relationship between position and density within the test pattern 171. It is not particularly limited how to acquire the density information of the test pattern 171. For example, one method is dividing the test pattern 171 into a plurality of areas A1 to An each having a predetermined area of "Y dot"×"X dot" to acquire an average density for each of the areas A1 to An.

Specifically, for example, when density data in a longitudinal direction of the medium 10 of A4 size is acquired at a resolution of 600 dot per inch (dpi) with the "X dot" equal to 1 dot, the density data acquired is data for about 4960 areas (i.e., areas A1 to An), which is calculated by a formula of 210 mm×(600 dpi/25.4 mm). If the density data is represented by 8 bits (i.e., from 0 to 255), a storage capacity of 4960×8 bits=4.96 kilobytes is required. If the "X dot" equals 2 dots or 4 dots, required is a half or a quarter storage capacity, reducing construction cost of the density information storage unit 131. By contrast, if the "X dot" is excessively increased, the density of an increased area is averaged, lowering the accuracy of the density information. A value of the "X dot" is determined by ascertaining whether high-frequency density unevenness is dominant or low-frequency density unevenness is dominant in the target image forming system 1. The density data can be acquired as described above at a different resolution of, e.g., 1200 dpi or 400 dpi.

Note that a value of the "Y dot" does not affect the storage capacity. Therefore, the value of the "Y dot" is determined so as not to cause relatively large differences between results of detection of density, taking into account an unevenness in density in the conveyance direction (i.e., sub-scanning direction) in the target image forming system 1, including a non-periodic unevenness in density or a periodic unevenness in density due to, e.g., a cycle of the photoconductive drum 22, a cycle of the transfer belt 34, and a cycle of the developing device 24. However, an excessively increased value of the "Y dot" lengthens the time to acquire the density data. Therefore, the value of the "Y dot" is determined in consideration of a balance between required accuracy and data acquisition time (i.e., processing capacity).

Upon formation of the test pattern 171, the test processor 162 controls the light emitting unit 101 based on the light emission correction value 105 stored in the light emission correction value storage unit 102. In other words, the control unit 161 corrects or adjusts an amount of light based on the light emission correction value 105, so that the light emitting unit 101 outputs the amount of light corrected based on the light emission correction value 105 upon formation of the test pattern 171. In other words, the light emitting unit 101 outputs the amount of light adjusted so as to suppress variations in density arising from the characteristic of the constituent element of the light emitting unit 101 such as the LED head 11. The image forming unit 111 forms the test pattern 171 with the amount of light corrected based on the light emission correction value 105. That is, the image forming unit 111 forms the test pattern 171 without being affected by the characteristic of the light emitting unit 101.

Figure 5:
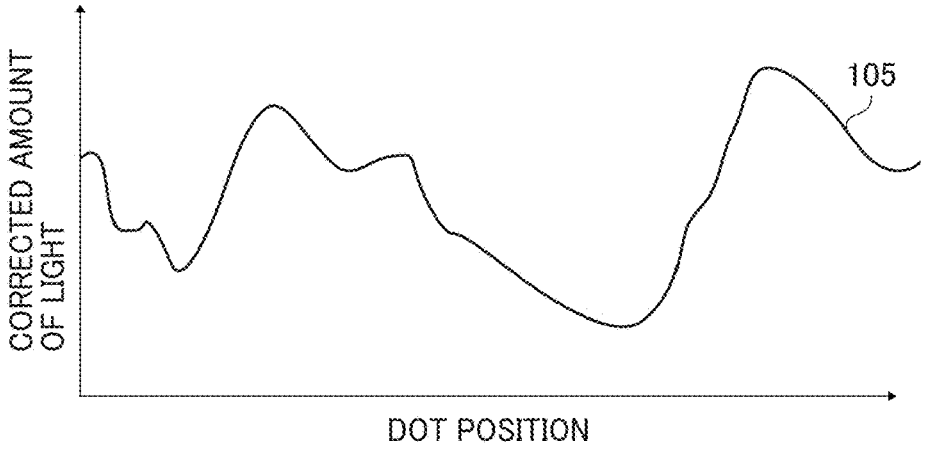
FIG. 5 is a graph of a light emission correction value according to the first embodiment.

FIG. 5 is a graph of the light emission correction value 105 according to the first embodiment.

The graph of FIG. 5 illustrates a relationship between dot position of the medium 10 in the main scanning direction (i.e., direction perpendicular to the conveyance direction) and corrected amount of light that is outputted from the light emitting unit 101.

Figure 6:
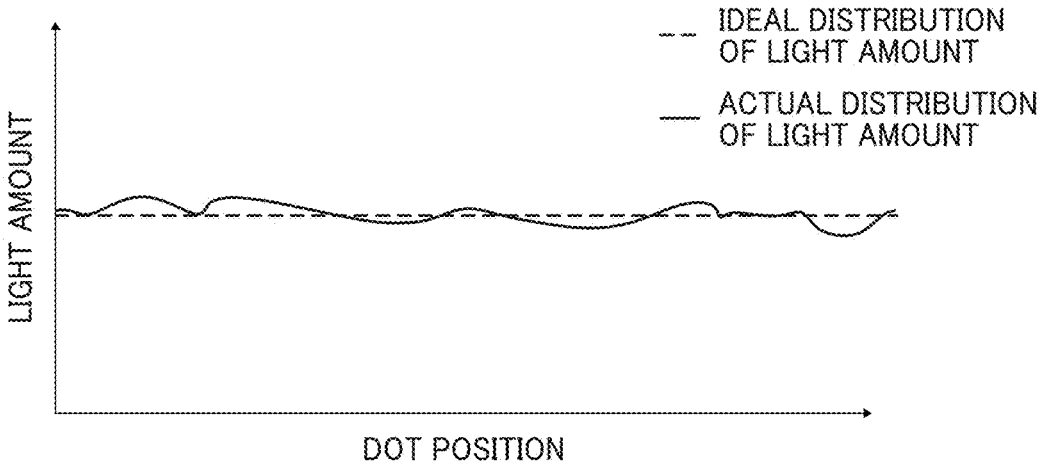
FIG. 6 is a graph of a distribution of light amount corrected based on the light emission correction value according to the first embodiment.

FIG. 6 is a graph of a distribution of light amount (i.e., amount of light) corrected based on the light emission correction value 105 according to the first embodiment.

The graph of FIG. 6 illustrates a relationship between the dot position of the medium 10 in the main scanning direction and the amount of light that is outputted from the light emitting unit 101. In FIG. 6, the broken line indicates an ideal distribution of light amount while the solid line indicates an actual distribution of light amount. The actual distribution of light amount is the distribution of light amount corrected based on the light emission correction value 105 illustrated in FIG. 5. FIG. 6 illustrates that the actual distribution of light amount substantially coincides with the ideal distribution of light amount. That is, the control unit 161 controls the amount of light based on the light emission correction value 105, thereby adjusting the amount of light that is outputted from the light emitting unit 101 so as to cancel unfavorable circumstances arising from the characteristic of the light emitting unit 101, specifically the characteristics of the constituent elements of the light emitting unit 101 such as the LED head 11. In the present example, FIG. 6 illustrates the light amount on the vertical axis. Alternatively, the vertical axis may indicate a value corresponding to the light amount, such as a light beam diameter.

As described above, the image forming unit 111 forms the test pattern 171 with the light corrected based on the light emission correction value 105. The density information acquiring unit 121 acquires the density information of the test pattern 171 thus formed. The density information storage unit 131 stores the density information thus acquired.

Figure 7:
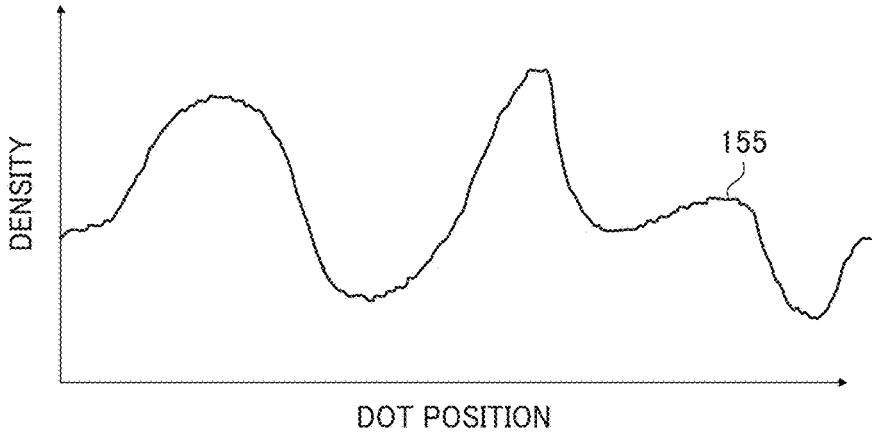
FIG. 7 is a graph of density information of the test pattern formed with light corrected based on the light emission correction value according to the first embodiment.

FIG. 7 is a graph of first density information 155 of the test pattern 171 formed with the light corrected based on the light emission correction value 105 according to the first embodiment.

The graph of FIG. 7 illustrates a relationship between the dot position of the medium 10 in the main scanning direction and the density of the test pattern 171. FIG. 7 illustrates a density fluctuation according to the dot position. Such a density fluctuation or variations in density may be mainly attributed to the characteristic of the image forming unit 111, specifically, the characteristics of the constituent elements of the image forming unit 111 such as the image forming engine 21 and the conveyor device 31. This is because the test pattern 171 corresponding to the graph of FIG. 7 is an image formed with the light controlled so as to cancel unfavorable circumstances arising from the characteristic of the light emitting unit 101 as described above.

Figure 8:
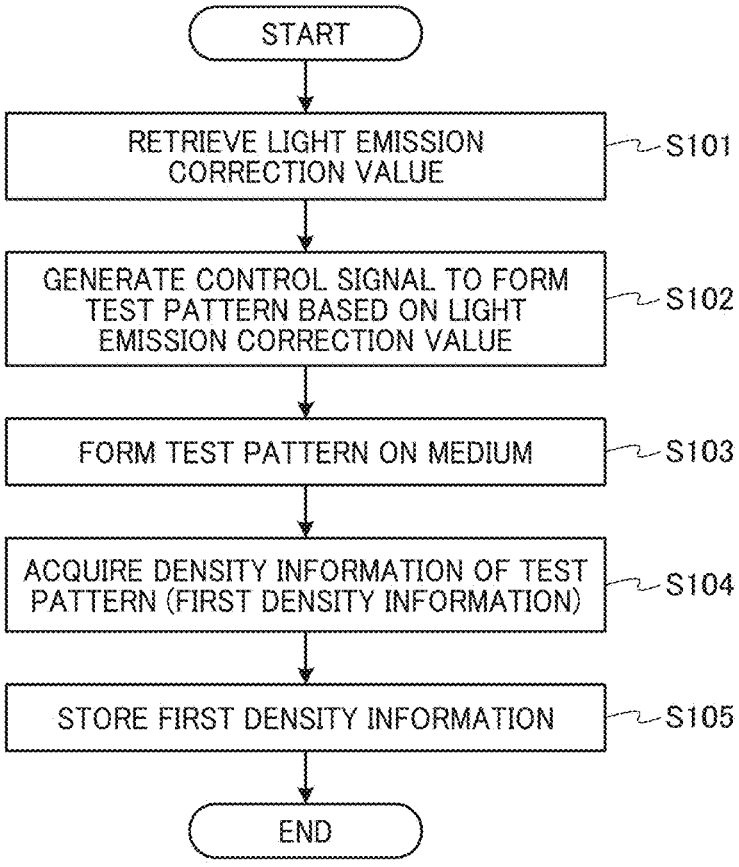
FIG. 8 is a flowchart of test processing executed in the image forming system according to the first embodiment.

Referring now to FIG. 8, a description is given of a flow of the test processing executed in the image forming system 1.

FIG. 8 is a flowchart of the test processing executed in the image forming system 1 according to the first embodiment.

Firstly, the test processor 162 retrieves the light emission correction value 105 from the light emission correction value storage unit 102 in step S101. In step S102, the control unit 161, specifically, the test processor 162 of the control unit 161, generates a control signal to form the test pattern 171 based on the light emission correction value 105. The control signal includes, e.g., a signal to control the light emitting unit 101 such that the light emitting unit 101 outputs an amount of light corresponding to the light emission correction value 105, and a signal to control the image forming unit 111 such that the image forming unit 111 forms the test pattern 171 on the medium 10 with the light corrected based on the light emission correction value 105. In step S103, the image forming unit 111 forms the test pattern 171 on the medium 10 with the light corrected based on the light emission correction value 105. Then, the density information acquiring unit 121 detects or acquires the density information of the test pattern 171, that is, the first density information 155, in step S104. In step S105, the density information storage unit 131 stores the first density information 155.

Figure 9:
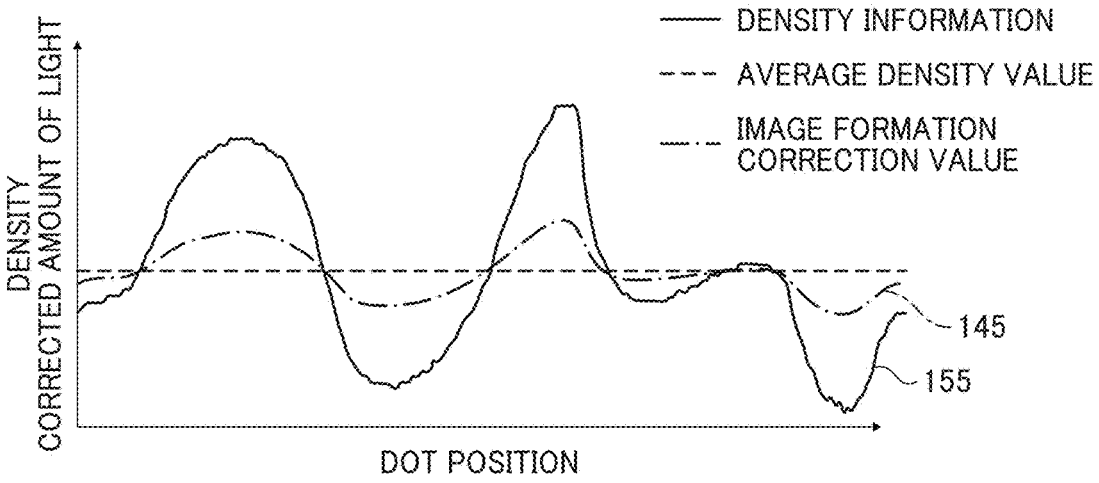
FIG. 9 is a graph of a relationship between the density information and an image formation correction value according to the first embodiment.
Figure 10:
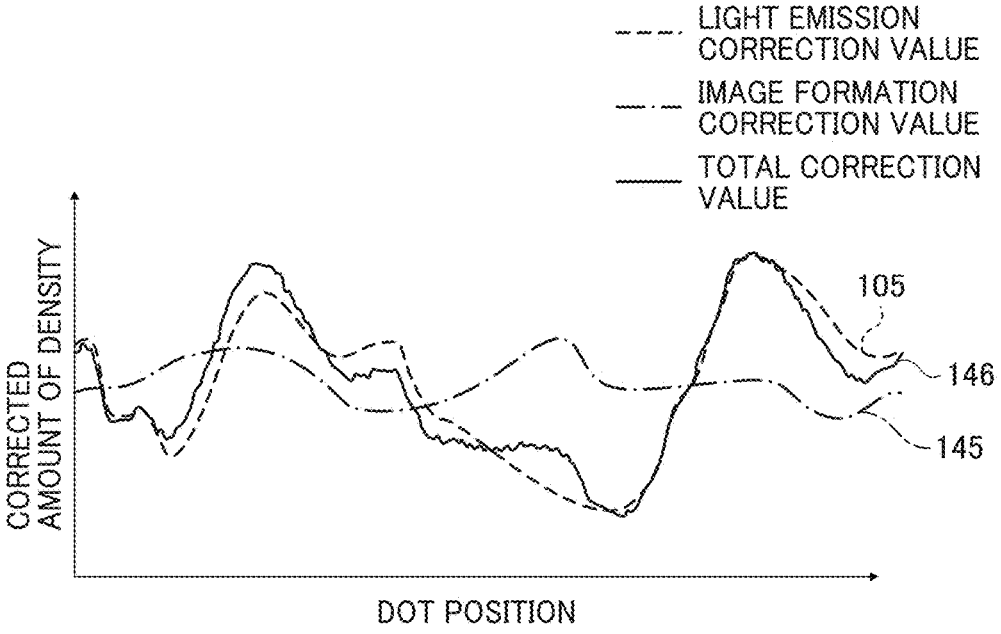
FIG. 10 is a graph of a relationship between the light emission correction value, the image formation correction value, and a total correction value according to the first embodiment.
Figure 11:
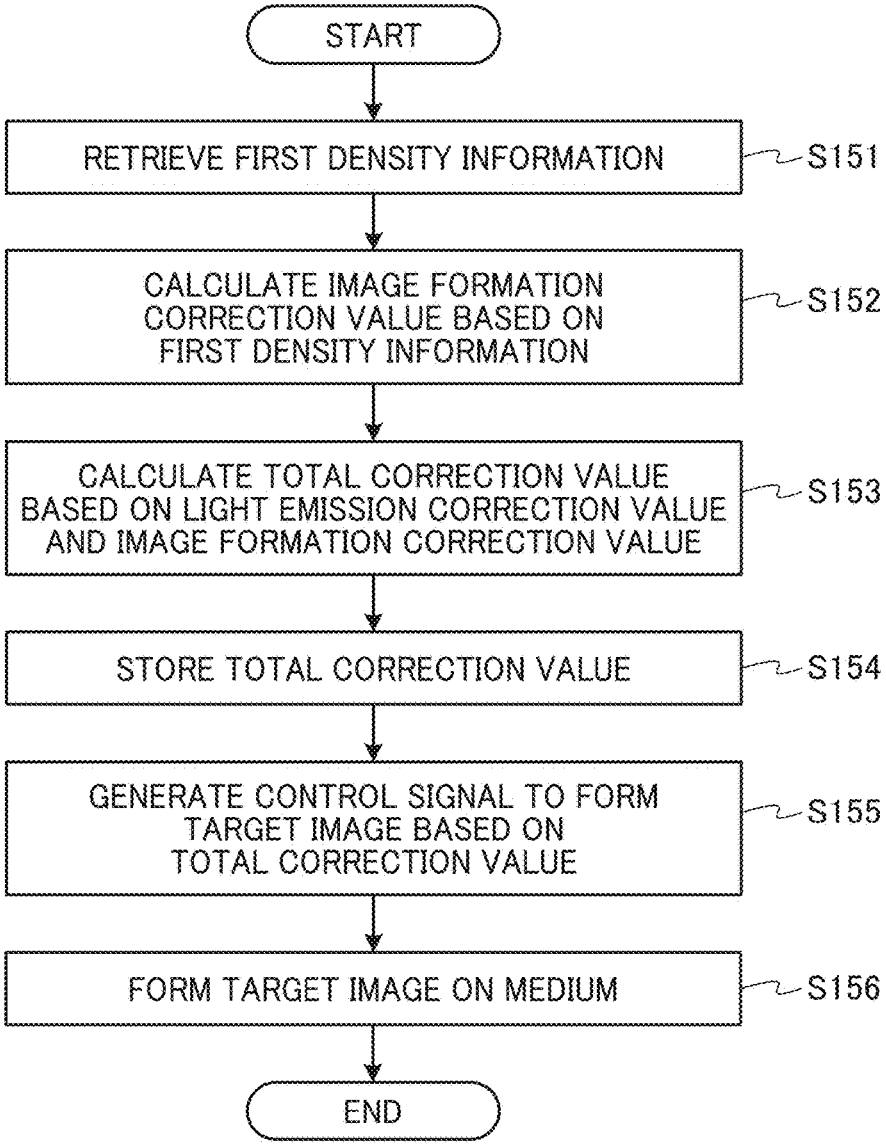
FIG. 11 is a flowchart of print processing executed in the image forming system according to the first embodiment.

Referring now to FIGS. 9 through 11, and with continued reference to FIG. 3, a description is given of the print processing and calculation of correction values.

Hereinafter, a description is given of operations performed by the functional units described above during the print processing. The print processing includes, e.g., processing of calculating correction values and processing of forming a target image based on a correction value.

The correction value calculating unit 141 calculates the image formation correction value 145 based on the first density information 155 stored in the density information storage unit 131. As described above, the first density information 155 is the density information of the test pattern 171 formed with the light corrected based on the light emission correction value 105. The image formation correction value 145 is a correction value corresponding to the characteristic of the image forming unit 111, specifically, the characteristics of the constituent elements of the image forming unit 111 such as the image forming engine 21 and the conveyor device 31. The image formation correction value 145 suppresses variations in density arising from the characteristic of the image forming unit 111. Since the first density information 155 indicates variations in the density of the test pattern 171 formed with the light corrected based on the light emission correction value 105, the variations in density indicated by the first density information 155 may be attributed to the characteristic of the image forming unit 111. Therefore, based on the first density information 155, the correction value calculating unit 141 calculates the image formation correction value 145 that is set so as to suppress variations in density arising from the characteristic of the image forming unit 111.

FIG. 9 is a graph of a relationship between the first density information 155 and the image formation correction value 145 according to the first embodiment.

Specifically, FIG. 9 illustrates a relationship among the first density information 155, average density value, and the image formation correction value 145. In FIG. 9, the solid line indicates the first density information 155. The broken line indicates the average density value. The long dashed short dashed line indicates the image formation correction value 145. The average density value indicates an average value of the density indicated by the first density information 155. The image formation correction value 145 is calculated based on the average density value and the density indicated by the first density information 155. In the present example, the image formation correction value 145 is set to increase the amount of light at a position where the density indicated by the first density information 155 is higher than the average value and to decrease the amount of light at a position where the density indicated by the first density information 155 is lower than the average value.

The correction value calculating unit 141 calculates the total correction value 146 based on the light emission correction value 105 stored in the light emission correction value storage unit 102 and the image formation correction value 145 calculated as described above. The total correction value 146 is a correction value corresponding to both the characteristic of the light emitting unit 101 and the characteristic of the image forming unit 111. The total correction value 146 suppresses variations in density arising from both the characteristic of the light emitting unit 101 and the characteristic of the image forming unit 111.

FIG. 10 is a graph of a relationship between the light emission correction value 105, the image formation correction value 145, and the total correction value 146 according to the first embodiment.

In FIG. 10, the broken line indicates the light emission correction value 105. The long dashed short dashed line indicates the image formation correction value 145. The solid line indicates the total correction value 146. It is not particularly limited how to calculate the total correction value 146. In the present example, the total correction value 146 is calculated by simply adding the light emission correction value 105 and the image formation correction value 145. The way of calculating the total correction value 146 is not limited thereto, but may change depending on how the light emission correction value 105 and the image formation correction value 145 are calculated.

The total correction value storage unit 151 stores the total correction value 146 calculated as described above. Upon formation of a target image, herein referred to as a first target image, the target image forming processor 163 controls the light emitting unit 101 based on the total correction value 146 stored in the total correction value storage unit 151. In other words, the control unit 161 corrects or adjusts the amount of light based on the total correction value 146, so that the light emitting unit 101 outputs light or the amount of light corrected based on the total correction value 146 upon formation of the first target image. That is, the light emitting unit 101 outputs the amount of light adjusted so as to suppress variations in density arising from the characteristic of the light emitting unit 101 and the characteristic of the image forming unit 111. The image forming unit 111 forms the first target image with the amount of light corrected based on the total correction value 146. That is, the image forming unit 111 forms the first target image without being affected by the characteristic of the light emitting unit 101 or the characteristic of image forming unit 111.

Referring now to FIG. 11, a description is given of a flow of the print processing executed in the image forming system 1.

FIG. 11 is a flowchart of the print processing executed in the image forming system 1 according to the first embodiment.

Firstly, the correction value calculating unit 141 retrieves the first density information 155 from the density information storage unit 131 in step S151. Then, the correction value calculating unit 141 calculates the image formation correction value 145 based on the first density information 155 in step S152. In step S153, the correction value calculating unit 141 calculates the total correction value 146 based on the light emission correction value 105 stored in the light emission correction value storage unit 102 and the image formation correction value 145 thus calculated. Then, the total correction value storage unit 151 stores the total correction value 146 in step S154. In step S155, the control unit 161, specifically, the target image forming processor 163 of the control unit 161, generates a control signal to form a target image (i.e., first target image) based on the total correction value 146. Then, the image forming unit 111 forms the target image on the medium 10 with light corrected based on the total correction value 146 in step S156.

According to the first embodiment described above, the variations in density arising from the characteristics of the constituent elements of the image forming system 1 are suppressed, thereby enhancing image quality.

Hereinafter, a description is given of some other embodiments of the present disclosure with reference to the drawings. Like reference numerals are given to constituent elements having the same or similar functions and advantages as those of the first embodiment. Redundant descriptions thereof may be omitted unless otherwise required.

Figure 12:
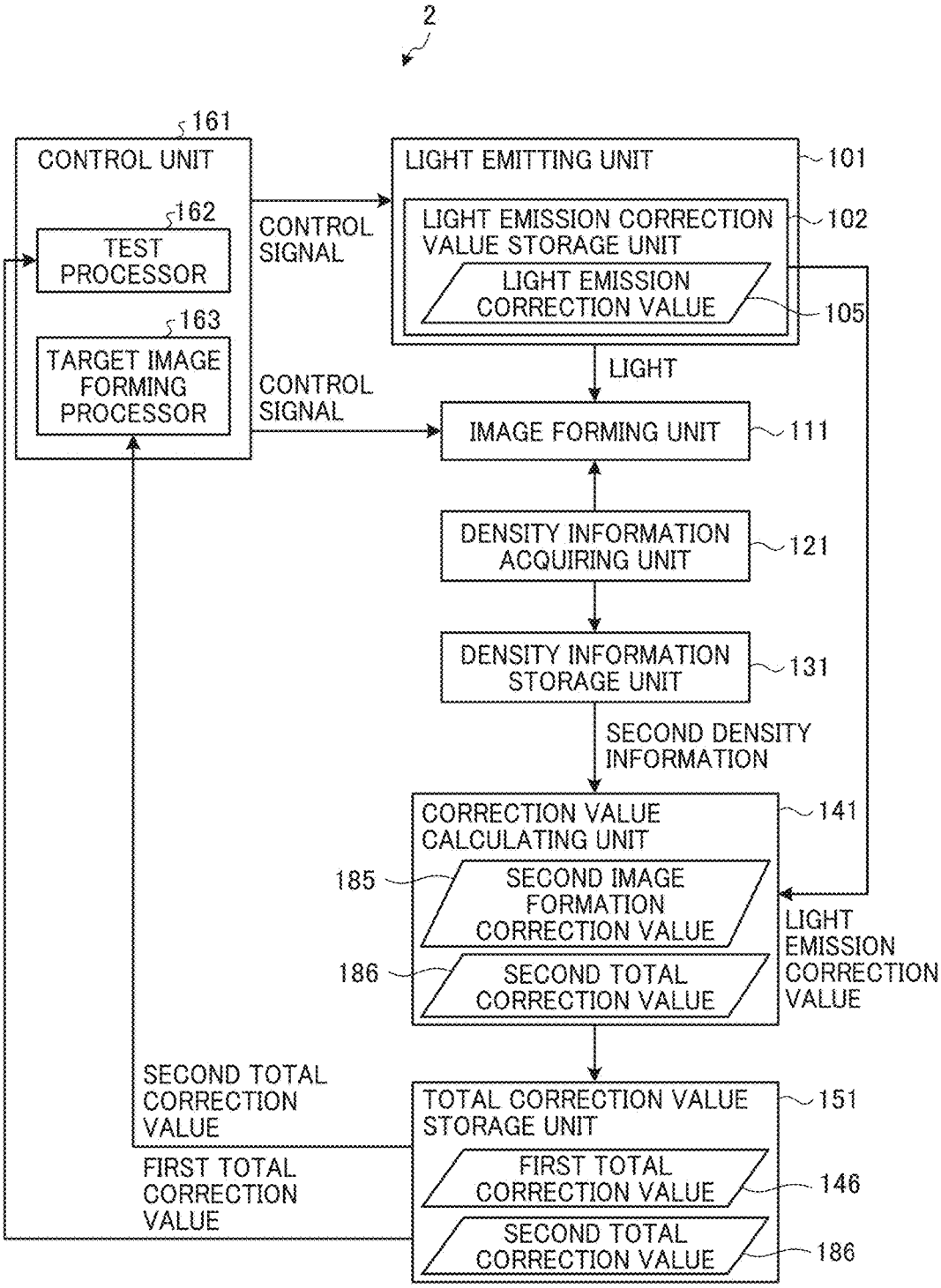
FIG. 12 is a block diagram of a functional structure of an image forming system according to a second embodiment.
Figure 13:
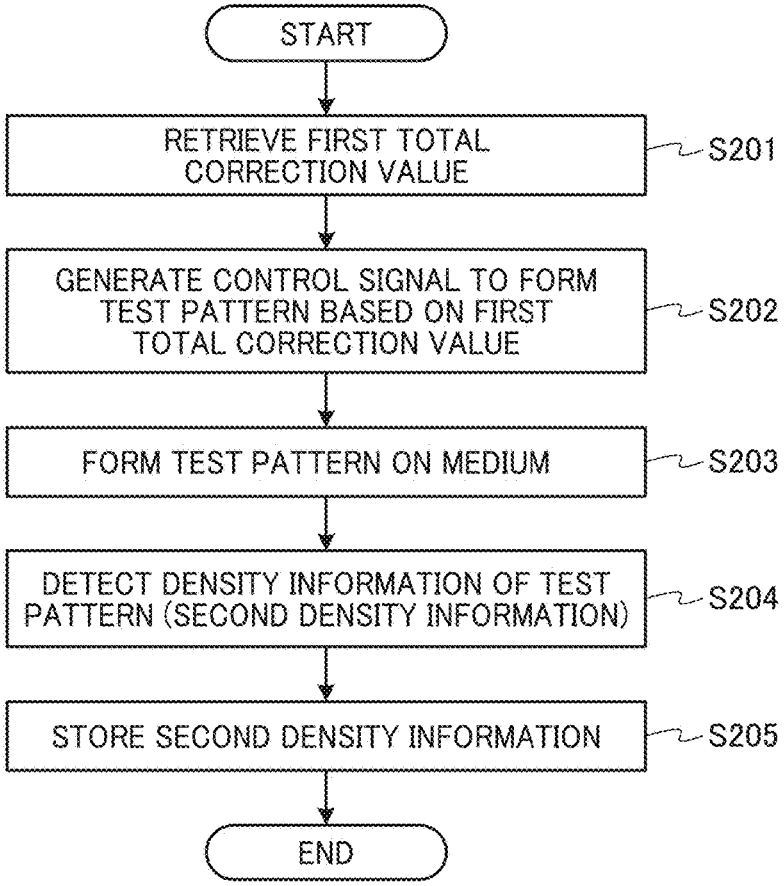
FIG. 13 is a flowchart of test processing executed in the image forming system according to the second embodiment.
Figure 14:
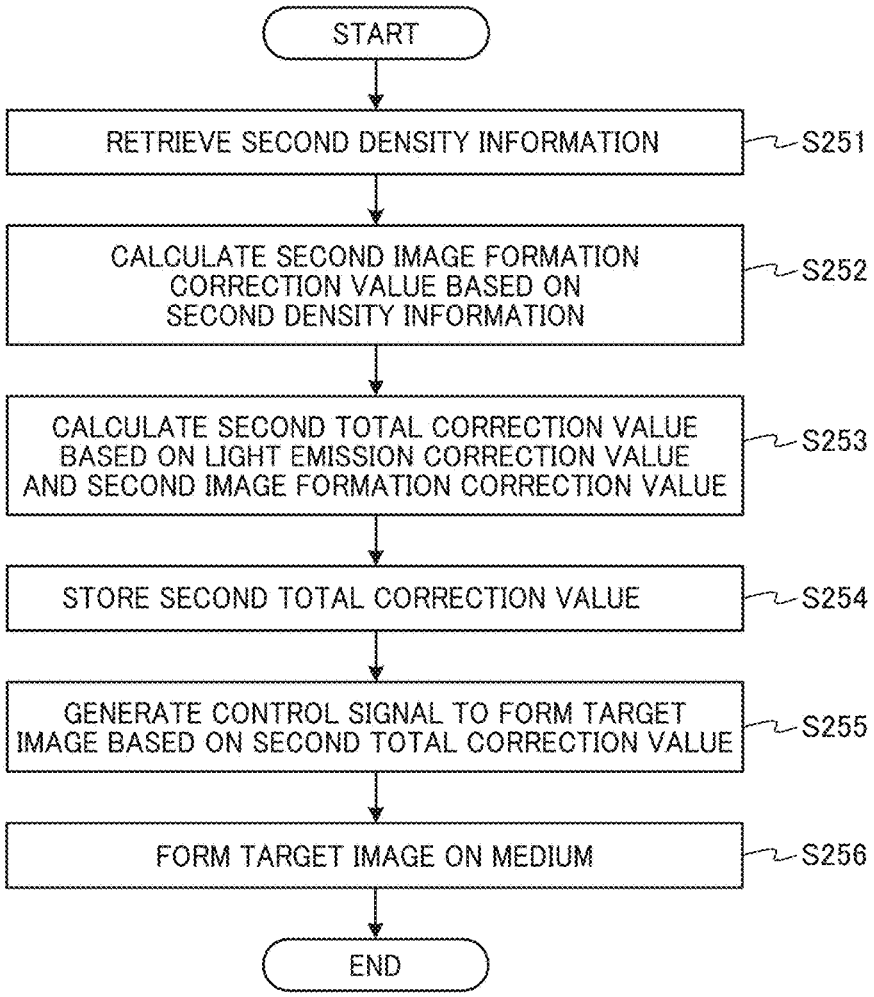
FIG. 14 is a flowchart of print processing executed in the image forming system according to the second embodiment.

Referring now to FIGS. 12 through 14, a description is given of a second embodiment of the present disclosure.

FIG. 12 is a block diagram of a functional structure of an image forming system 2 according to the second embodiment.

Firstly, a description is given of formation of a test pattern.

According to the second embodiment, the test processor 162 performs processing to execute test processing based on the total correction value 146, herein referred to as a first total correction value 146, stored in the total correction value storage unit 151. The first total correction value 146 is the same data as the total correction value 146 stored in the total correction value storage unit 151 according to the first embodiment illustrated in FIG. 3. In the first embodiment, the target image forming processor 163 uses the total correction value 146, which is equivalent to the first total correction value 146 of the second embodiment, to form the first target image. By contrast, in the second embodiment, the first total correction value 146 is used to form the test pattern 171, herein serving as a second test image.

Upon formation of the test pattern 171, the test processor 162 controls the light emitting unit 101 based on the first total correction value 146. In other words, the control unit 161 corrects the amount of light based on the first total correction value 146, so that the light emitting unit 101 outputs the amount of light corrected based on the first total correction value 146 upon formation of the test pattern 171. The image forming unit 111 forms the test pattern 171 with the amount of light corrected based on the first total correction value 146.

Now, a description is given of acquisition of second density information.

According to the second embodiment, the density information acquiring unit 121 acquires the second density information indicating a characteristic of density of the test pattern 171 (i.e., second test image), which is formed with the light corrected based on the first total correction value 146 as described above. The second density information is stored in the density information storage unit 131.

Now, a description is given of calculation of a second image formation correction value.

According to the second embodiment, the correction value calculating unit 141 calculates a second image formation correction value 185, serving as a fourth correction value, based on the second density information stored in the density information storage unit 131. As described above, the second density information is the density information of the test pattern 171 formed with the light corrected based on the first total correction value 146. The correction value calculating unit 141 calculates the second image formation correction value 185 to further reduce variations in the density of the test pattern 171 corresponding to the second density information.

Now, a description is given of calculation of a second total correction value.

According to the second embodiment, the correction value calculating unit 141 calculates a second total correction value 186, serving as a fifth correction value, based on the light emission correction value 105 stored in the light emission correction value storage unit 102 and the second image formation correction value 185 calculated as described above. It is not particularly limited how to calculate the second total correction value 186. For example, the second image formation correction value 185 may be calculated by simply adding the light emission correction value 105 and the second image formation correction value 185. The second total correction value 186 is a value that further reduces variations in density compared to the first total correction value 146. The second total correction value 186 is stored in the total correction value storage unit 151.

Now, a description is given of formation of a target image, herein referred to as a second target image.

Upon formation of the second target image, the target image forming processor 163 of the second embodiment controls the light emitting unit 101 based on the second total correction value 186 stored in the total correction value storage unit 151. In other words, the control unit 161 corrects the amount of light based on the second total correction value 186, so that the light emitting unit 101 outputs the amount of light corrected based on the second total correction value 186 upon formation of the second target image. The image forming unit 111 forms the second target image with the amount of light corrected based on the second total correction value 186. That is, in the second embodiment, the second target image is formed further suppressing variations in density compared to the first embodiment in which the first target image is formed with the light corrected based on the total correction value 146.

Referring now to FIG. 13, a description is given of a flow of the test processing.

FIG. 13 is a flowchart of the test processing executed in the image forming system 2 according to the second embodiment.

Firstly, the test processor 162 retrieves the first total correction value 146 from the total correction value storage unit 151 in step S201. In step S202, the control unit 161, specifically, the test processor 162 of the control unit 161, generates a control signal to form the test pattern 171 based on the first total correction value 146. The control signal includes, e.g., a signal to control the light emitting unit 101 such that the light emitting unit 101 outputs an amount of light corresponding to the first total correction value 146, and a signal to control the image forming unit 111 such that the image forming unit 111 forms the test pattern 171 on the medium 10 with the light corrected based on the first total correction value 146. In step S203, the image forming unit 111 forms the test pattern 171 on the medium 10 with the light corrected based on the first total correction value 146. Then, the density information acquiring unit 121 detects or acquires the density information of the test pattern 171, that is, the second density information, in step S204. In step S205, the density information storage unit 131 stores the second density information.

Referring now to FIG. 14, a description is given of print processing and calculation of correction values.

FIG. 14 is a flowchart of the print processing executed in image the forming system 2 according to the second embodiment.

Firstly, the correction value calculating unit 141 retrieves the second density information from the density information storage unit 131 in step S251. Then, the correction value calculating unit 141 calculates the second image formation correction value 185 based on the second density information in step S252. In step S253, the correction value calculating unit 141 calculates the second total correction value 186 based on the light emission correction value 105 stored in the light emission correction value storage unit 102 and the second image formation correction value 185 thus calculated. Then, the total correction value storage unit 151 stores the second total correction value 186 in step S254. In step S255, the control unit 161, specifically, the target image forming processor 163 of the control unit 161, generates a control signal to form a target image (i.e., second target image) based on the second total correction value 186. Then, the image forming unit 111 forms the target image on the medium 10 with the light corrected based on the second total correction value 186 in step S256.

According to the second embodiment described above, the variations in density are further suppressed, thereby enhancing image quality, compared to the first embodiment.

Figure 15:
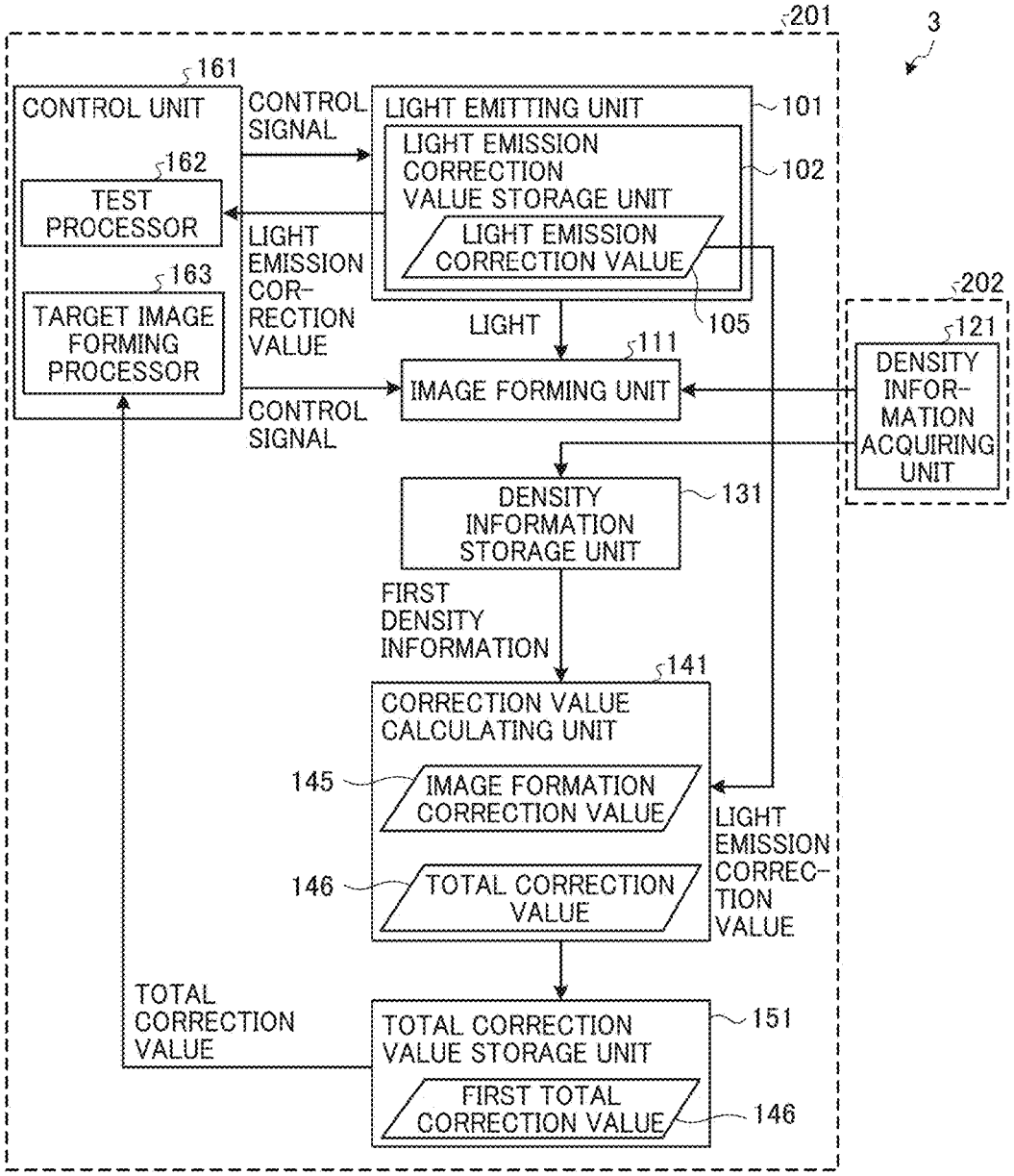
FIG. 15 is a block diagram of a functional structure of an image forming system according to a third embodiment.

Referring now to FIG. 15, a description is given of a third embodiment of the present disclosure.

FIG. 15 is a block diagram of a functional structure of an image forming system 3 according to the third embodiment.

Similarly to the image forming system 1 of the first embodiment illustrated in FIG. 3, the image forming system 3 of the third embodiment includes the light emitting unit 101, the image forming unit 111, the density information acquiring unit 121, the density information storage unit 131, the correction value calculating unit 141, the total correction value storage unit 151, and the control unit 161. These functional units (i.e., the light emitting unit 101, the image forming unit 111, the density information acquiring unit 121, the density information storage unit 131, the correction value calculating unit 141, the total correction value storage unit 151, and the control unit 161) have functions similar to those of the first embodiment.

Unlike the image forming systems 1 and 2 described above, the image forming system 3 of the third embodiment further includes an image forming apparatus 201, serving as a first unit, and an external device 202 serving as a second unit. Each of the image forming apparatus 201 and the external device 202 has an independent hardware structure. Specifically, as illustrated in FIG. 15, the image forming apparatus 201 includes the light emitting unit 101, the image forming unit 111, the density information storage unit 131, the correction value calculating unit 141, the total correction value storage unit 151, and the control unit 161. The light emitting unit 101 includes the light emission correction value storage unit 102. On the other hand, the external device 202 includes the density information acquiring unit 121. The image forming apparatus 201 is an independent apparatus such as a printer, a copier, a facsimile machine, or a multifunction peripheral (MFP) having at least two of printing, copying, scanning, facsimile, and plotter functions. The external device 202 is an independent device that is used to execute processing of acquiring density information. The external device 202 includes the sensor device 41 and the like constructing the density information acquiring unit 121.

Thus, the external device 202, which is independent from the image forming apparatus 201, may have a function of the density information acquiring unit 121, that is, a function of acquiring density information that is used to calculate a correction value. Accordingly, the external device 202 can be shared among a plurality of image forming apparatuses 201 that is not provided with constituent elements of the density information acquiring unit 121.

Figure 16:
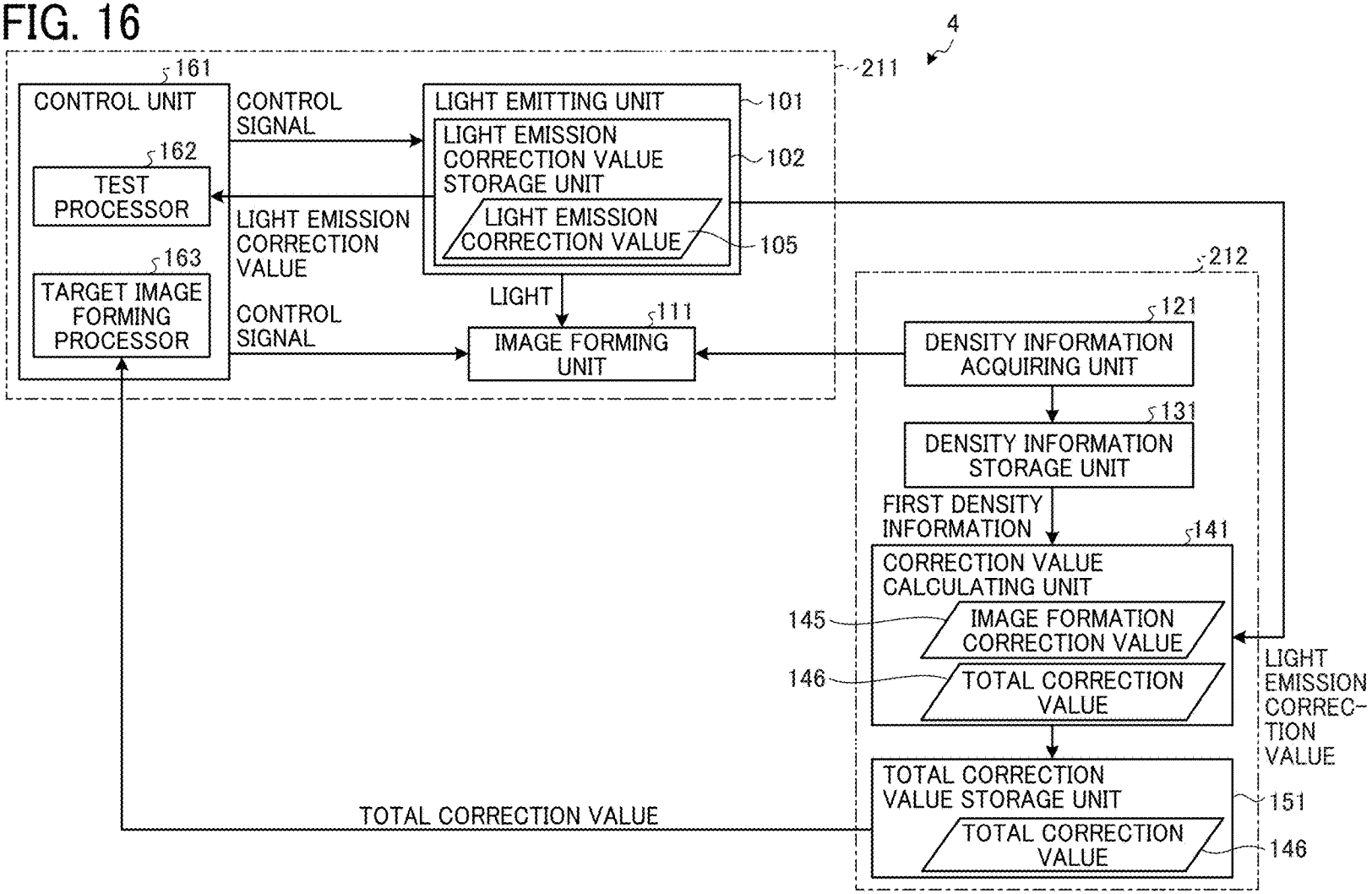
FIG. 16 is a block diagram of a functional structure of an image forming system according to a fourth embodiment.

Referring now to FIG. 16, a description is given of a fourth embodiment of the present disclosure.

FIG. 16 is a block diagram of a functional structure of an image forming system 4 according to the fourth embodiment.

Similarly to the image forming system 1 of the first embodiment illustrated in FIG. 3, the image forming system 4 of the fourth embodiment includes the light emitting unit 101, the image forming unit 111, the density information acquiring unit 121, the density information storage unit 131, the correction value calculating unit 141, the total correction value storage unit 151, and the control unit 161. These functional units (i.e., the light emitting unit 101, the image forming unit 111, the density information acquiring unit 121, the density information storage unit 131, the correction value calculating unit 141, the total correction value storage unit 151, and the control unit 161) have functions similar to those of the first embodiment.

Unlike the image forming systems 1 and 2 described above, the image forming system 4 of the fourth embodiment further includes an image forming apparatus 211, serving as a first unit, and an external device 212 serving as a second unit. Each of the image forming apparatus 211 and the external device 212 has an independent hardware structure. Unlike the third embodiment, the image forming apparatus 211 of the fourth embodiment includes the light emitting unit 101, the image forming unit 111, and the control unit 161, as illustrated in FIG. 16. The light emitting unit 101 includes the light emission correction value storage unit 102. On the other hand, the external device 212 of the fourth embodiment includes the density information acquiring unit 121, the density information storage unit 131, the correction value calculating unit 141, and the total correction value storage unit 151, as illustrated in FIG. 16. The image forming apparatus 211 is an independent apparatus such as a printer, a copier, a facsimile machine, or a multifunction peripheral (MFP) having at least two of printing, copying, scanning, facsimile, and plotter functions. The external device 212 is an independent device that is used to execute, e.g., processing of acquiring density information and processing of calculating a correction value. The external device 212 includes, e.g., the sensor device 41 as a constituent element of the density information acquiring unit 121, a memory as a constituent dement of the density information storage unit 131, a micro processing unit (MPU) as a constituent element of the correction value calculating unit 141, and a memory as a constituent element of the total correction value storage unit 151.

Thus, the functions of the density information acquiring unit 121, the density information storage unit 131, the correction value calculating unit 141, and the total correction value storage unit 151, in other words, the functions of acquiring density information and calculating a correction value based on the density information, may be provided outside the image forming apparatus 211, for example, in the external device 212 as described above. Accordingly, the external device 212 can be shared among a plurality of image forming apparatuses 211 that is not provided with the density information acquiring unit 121, the density information storage unit 131, the correction value calculating unit 141, and the total correction value storage unit 151.

Figure 17:
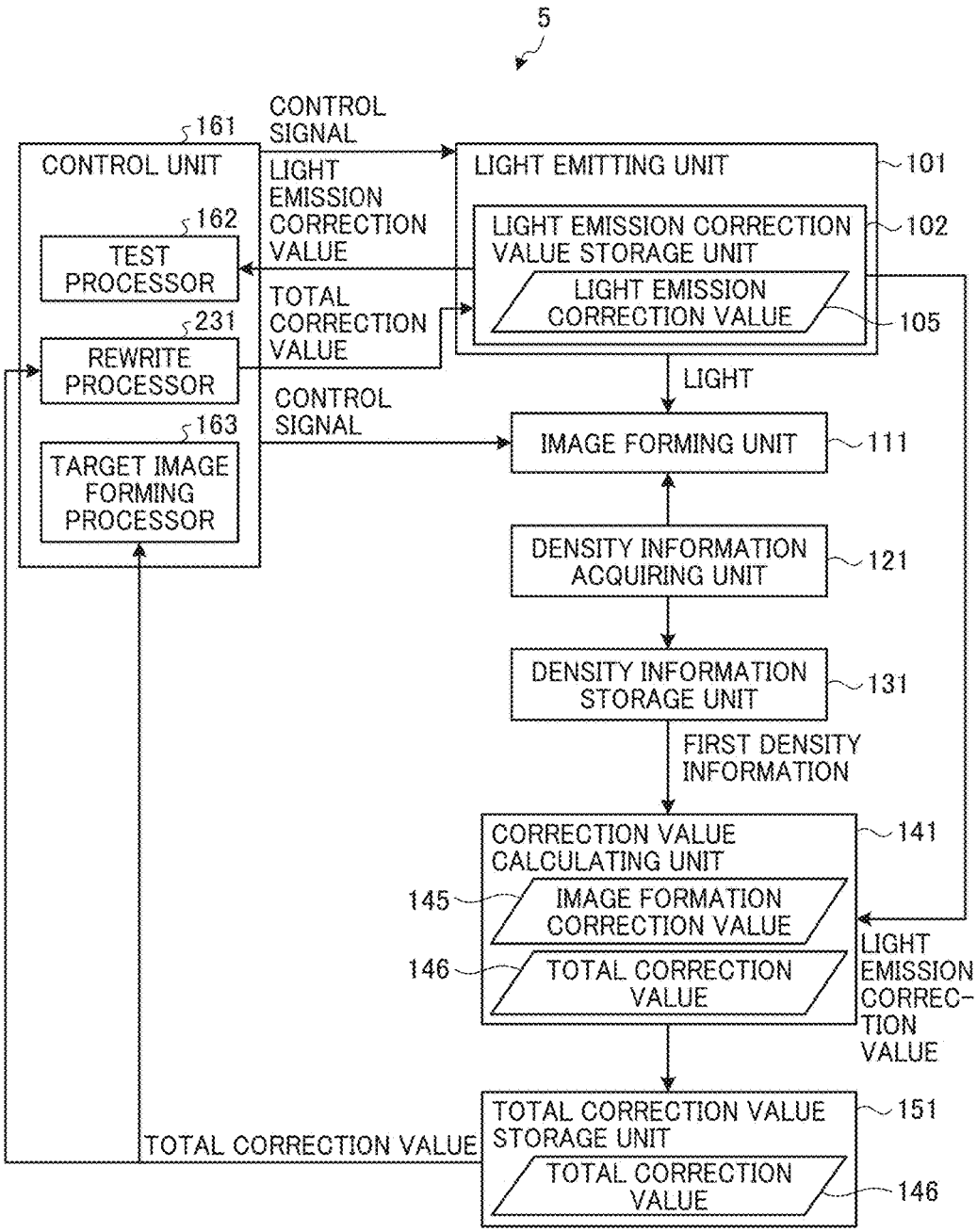
FIG. 17 is a block diagram of a functional structure of an image forming system according to a fifth embodiment.

Referring now to FIG. 17, a description is given of a fifth embodiment of the present disclosure.

FIG. 17 is a block diagram of a functional structure of an image forming system 5 according to the fifth embodiment.

The image forming system 5 of the fifth embodiment differs from the image forming system 1 of the first embodiment in that the control unit 161 includes a rewrite processor 231 serving as a rewriter.

The rewrite processor 231 performs processing to rewrite the light emission correction value 105 stored in the light emission correction value storage unit 102 to a correction value calculated by the correction value calculating unit 141. In the present example, the rewrite processor 231 retrieves the total correction value 146 from the total correction value storage unit 151. Then, the rewrite processor 231 rewrites the light emission correction value 105 stored in the light emission correction value storage unit 102 to the total correction value 146.

Accordingly, variations in the density of the test pattern 171 formed with the light corrected based on the light emission correction value 105 thus rewritten are smaller than variations in the density of the test pattern 171 formed with the light corrected based on the light emission correction value 105 before being rewritten. In short, rewriting the light emission correction value 105 reduces variations in the density of the test pattern 171. Therefore, the image formation correction value 145 and the total correction value 146 calculated after the light emission correction value 105 is rewritten are more effective in suppressing variations in density than the image formation correction value 145 and the total correction value 146 calculated before the light emission correction value 105 is rewritten. In short, rewriting the light emission correction value 105 enhances calculation of the image formation correction value 145 and the total correction value 146 to further suppress variations in density. As a consequence, the image quality is enhanced.

If execution of a program implements at least a part of the function of each of the image forming systems 1 through 5 according to the first through fifth embodiments, respectively, the program is provided while being incorporated in advance in an appropriate storage device (e.g., ROM 54) included in the image forming system. Alternatively, the program may be provided while being recorded on a computer-readable recording medium such as a compact disc read-only memory (CD-ROM), a flexible disk (FD), a compact disc recordable (CD-R), or a digital versatile or digital video disk (DVD), in a tile in installable or executable format. Alternatively, the program may be configured to be stored in a computer connected to a network, such as the Internet, to be downloaded via the network. Thus, the program may be provided. The program may be configured to be provided or distributed via a network such as the Internet. The program may have a module configuration including at least a part of each of the functions described above.

According to the embodiments described above, variations in density are suppressed depending on the characteristic of constituent elements of the image forming system, thereby enhancing image quality.

Although the present disclosure makes reference to specific embodiments, it is to be noted that the present disclosure is not limited to the details of the embodiments described above and various modifications and enhancements are possible without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

Any one of the above-described operations may be performed in various other ways, for example, in an order different from the one described above.

Further, any of the above-described devices or units can be implemented as a hardware apparatus, such as a special-purpose circuit or device, or as a hardware/software combination, such as a processor executing a software program.

Further, as described above, any one of the above-described and other methods of the present disclosure may be embodied in the form of a computer program stored in any kind of storage medium. Examples of storage mediums include, but are not limited to, flexible disks, hard disks, optical discs, magneto-optical discs, magnetic tapes, non-volatile memory cards, read only memories (ROMs), etc.

Alternatively any one of the above-described and other methods of the present disclosure may be implemented by an application specific integrated circuit (ASIC), prepared by interconnecting an appropriate network of conventional component circuits or by a combination thereof with one or more conventional general purpose microprocessors and/or signal processors programmed accordingly.

What is claimed is:

1. An image forming system comprising:

a light emitting device configured to output light;

a controller configured to control an amount of light to be output from the light emitting device;

a first storage device configured to store a first correction value corresponding to a characteristic of the light emitting device;

a controller configured to control an amount of light to be output from the light emitting device and to correct the amount of light based on the first correction value;

an image forming device configured to form a first test image on a medium using the amount of light corrected based on the first correction value and output from the light emitting device;

an acquiring device configured to acquire first density information indicating a characteristic of density of the first test image;

a calculator configured to calculate a second correction value based on the first density information acquired and corresponding to a characteristic of the image forming device and configured to calculate a third correction value based on the first correction value corresponding to a characteristic of the light emitting device and the second correction value corresponding to a characteristic of the image forming device;

the controller being further configured to control and correct the amount of light to be output from the light emitting device based on the third correction value, the image forming device being further configured to form a first target image on a medium using the amount of light being corrected based on the third correction value and output from the light emitting device; and a second storage device configured to store the third correction value, wherein the image forming device is configured to form a second test image on a medium using the amount of light corrected based on the third correction value, wherein the acquiring device is configured to acquire second density information indicating a characteristic of density of the second test image, wherein the calculator is configured to calculate a fourth correction value based on the second density information acquired and calculate a fifth correction value based on the first correction value and the fourth correction value, wherein the controller is further configured to control and correct the amount of light to be output from the light emitting device based on the fifth correction value, and wherein the image forming device is further configured to form a second target image on a medium using the amount of light corrected based on the fifth correction value and output from the light emitting device.

2. The image forming system according to claim 1, further comprising:

a first unit, the first unit including:

the light emitting device;

the controller;

the image forming device;

the first storage device;

the second storage device; and the calculator; and a second unit, the second unit including the acquiring device.

3. The image forming system according to claim 2, wherein the first unit is an image forming apparatus, and wherein the second unit is an external device.

4. The image forming system according to claim 1, further comprising:

a first unit, the first unit including:

the light emitting device;

the first storage device;

the controller; and the image forming device; and a second unit, the second unit including:

the acquiring device;

the second storage device; and the calculator.

5. The image forming system according to claim 4, wherein the first unit is an image forming apparatus, and wherein the second unit is an external device.

6. The image forming system according to claim 1, further comprising a rewriter configured to rewrite the first correction value stored in the first storage device to the correction value calculated by the calculator.

7. The image forming system according to claim 1, wherein the second correction value is a value set to suppress variations in the density of the image arising from a characteristic of the image forming device, and wherein the third correction value is a value set to suppress variations in the density of the image arising from the characteristic of the light emitting device and the characteristic of the image forming device.

8. The image forming system according to claim 7, wherein the image forming device includes a mechanism configured to form a latent image on a photoconductor using the light output from the light emitting device, to supply toner to the latent image, and to transfer the toner onto the medium.

9. The image forming system according to claim 1, wherein the second correction value is a value set to suppress variations in the density of the image arising from a characteristic of the image forming device, and wherein the third correction value is a value set to suppress variations in the density of the image arising from the characteristic of the light emitting device and the characteristic of the image forming device.

10. A non-transitory recording medium storing program code which, when executed by one or more processors, cause the one or more processors to perform a method of forming an image, the method comprising:

correcting an amount of light to be output from a light emitting device based on a first correction value corresponding to a characteristic of a light emitting device;

forming a first test image on a medium, with an image forming device, using the amount of light corrected based on the first correction value and output from the light emitting device;

acquiring first density information indicating a characteristic of density of the first test image;

calculating a second correction value based on the first density information acquired and corresponding to a characteristic of the image forming device;

calculating a third correction value based on the first correction value corresponding to a characteristic of the light emitting device and the second correction value corresponding to a characteristic of the image forming device;

correcting the amount of light to be output from the light emitting device based on the third correction value;

forming a first target image on a medium, with an image forming device, using the amount of light corrected based on the third correction value and output from the light emitting device;

forming a second test image on a medium using the amount of light corrected based on the third correction value;

acquiring second density information indicating a characteristic of density of the second test image;

calculating a fourth correction value based on the second density information acquired;

calculating a fifth correction value based on the first correction value and the fourth correction value;

correcting the amount of light to be output from the light emitting device based on the fifth correction value; and forming a second target image on a medium using the amount of light corrected based on the fifth correction value and output from the light emitting device.

11. The non-transitory recording medium of claim 10, wherein the second correction value is a value set to suppress variations in the density of the image arising from a characteristic of the image forming device, and wherein the third correction value is a value set to suppress variations in the density of the image arising from the characteristic of the light emitting device and the characteristic of the image forming device.

12. The non-transitory recording medium of claim 10, wherein the second correction value is a value set to suppress variations in the density of the image arising from a characteristic of the image forming device, and wherein the third correction value is a value set to suppress variations in the density of the image arising from the characteristic of the light emitting device and the characteristic of the image forming device.

13. A method of forming an image, the method comprising:

correcting an amount of light to be output from a light emitting device based on a first correction value corresponding to a characteristic of a light emitting device;

forming a first test image on a medium, with an image forming device, using the amount of light corrected based on the first correction value and output from the light emitting device;

acquiring first density information indicating a characteristic of density of the first test image;

calculating a second correction value based on the first density information acquired and corresponding to a characteristic of the image forming device;

calculating a third correction value based on the first correction value corresponding to a characteristic of the light emitting device and the second correction value corresponding to a characteristic of the image forming device;

correcting the amount of light to be output from the light emitting device based on the third correction value;

forming a first target image on a medium, with an image forming device, using the amount of light corrected based on the third correction value and output from the light emitting device;

forming a second test image on a medium using the amount of light corrected based on the third correction value;

acquiring second density information indicating a characteristic of density of the second test image;

calculating a fourth correction value based on the second density information acquired;

calculating a fifth correction value based on the first correction value and the fourth correction value;

correcting the amount of light to be output from the light emitting device based on the fifth correction value; and forming a second target image on a medium using the amount of light corrected based on the fifth correction value and output from the light emitting device.

14. The method of claim 13, wherein the second correction value is a value set to suppress variations in the density of the image arising from a characteristic of the image forming device, and wherein the third correction value is a value set to suppress variations in the density of the image arising from the characteristic of the light emitting device and the characteristic of the image forming device.

15. The method of claim 13, wherein the second correction value is a value set to suppress variations in the density of the image arising from a characteristic of the image forming device, and wherein the third correction value is a value set to suppress variations in the density of the image arising from the characteristic of the light emitting device and the characteristic of the image forming device.

* * * * *